US009199702B2

(12) United States Patent
Cregier et al.

(10) Patent No.: US 9,199,702 B2
(45) Date of Patent: Dec. 1, 2015

(54) COMBINATION KAYAK AND PADDLEBOARD WATERCRAFT APPARATUS AND RELATED METHODS

(71) Applicant: Kypad Inc., Salem, NH (US)

(72) Inventors: Patricia Cregier, Salem, NH (US); Stuart Guyott Lamb, Marblehead, MA (US); Kristen Hall Lamb, Marblehead, MA (US)

(73) Assignee: Kypad, Inc., Salem, MA (US)

( * ) Notice: Subject to any disclaimer, the term of this patent is extended or adjusted under 35 U.S.C. 154(b) by 38 days.

(21) Appl. No.: 14/108,836

(22) Filed: Dec. 17, 2013

(65) Prior Publication Data

US 2015/0166151 A1 Jun. 18, 2015

(51) Int. Cl.

| | |
|---|---|
| ***B63B 35/71*** | (2006.01) |
| ***B63B 35/79*** | (2006.01) |
| *B63B 29/04* | (2006.01) |

(52) U.S. Cl.

CPC ..... *B63B 35/71* (2013.01); *B63B 35/7906* (2013.01); *B63B 2029/043* (2013.01); *B63B 2035/715* (2013.01)

(58) Field of Classification Search

CPC ..... B63B 35/71; B63B 2035/715
USPC ..... 114/347
See application file for complete search history.

(56) References Cited

U.S. PATENT DOCUMENTS

| | | | | |
|---|---|---|---|---|
| 3,640,240 | A * | 2/1972 | Stein | 440/15 |
| 5,127,862 | A * | 7/1992 | Pia | 441/79 |
| 5,377,607 | A * | 1/1995 | Ross | 114/39.12 |
| 6,035,799 | A * | 3/2000 | Lukanovich et al. | 114/343 |
| 6,257,944 | B1 | 7/2001 | Herrod | |
| 7,121,225 | B1 * | 10/2006 | Caples | 114/347 |
| 7,198,529 | B2 | 4/2007 | Cleary | |
| 7,721,670 | B2 * | 5/2010 | Weber | 114/347 |
| 7,740,512 | B1 | 6/2010 | Patterson | |
| 8,336,475 | B2 | 12/2012 | Morin | |
| 8,573,146 | B2 * | 11/2013 | Lee et al. | 114/363 |
| 2002/0195039 | A1 * | 12/2002 | Anderson | 114/347 |
| 2003/0203686 | A1 | 10/2003 | Rothschild | |
| 2006/0042536 | A1 | 3/2006 | Cleary | |
| 2007/0012236 | A1 * | 1/2007 | Caples | 114/347 |
| 2007/0137552 | A1 * | 6/2007 | Bridges | 114/347 |
| 2011/0217889 | A1 | 9/2011 | Tom | |
| 2012/0077396 | A1 | 3/2012 | Lipman | |
| 2012/0318183 | A1 | 12/2012 | Chen | |
| 2013/0023169 | A1 | 1/2013 | Morrelli et al. | |
| 2015/0166151 | A1 * | 6/2015 | Cregier et al. | 114/347 |

* cited by examiner

*Primary Examiner* — Lars A Olson
*Assistant Examiner* — Jovon Hayes
(74) *Attorney, Agent, or Firm* — Hayes Soloway PC

(57) ABSTRACT

A combination kayak and paddleboard watercraft includes a hull formed from a substantially solid foam core. A rigid exterior coating is positioned on an exterior surface of the hull. A seating area is formed on the exterior coating proximate to a top surface of the hull and has a seating cavity extending into the substantially solid foam core. A foot hold area is formed on the rigid exterior coating proximate to the top surface of the hull and has at least two foot cavities extending into the substantially foam core. A standing area is formed on the rigid exterior coating proximate to the top surface of the hull and is positioned substantially between the seating area and the foot hold area, wherein the standing area further comprises a standing pad affixed to at least one of the hull and the rigid exterior coating.

20 Claims, 9 Drawing Sheets

COMBINATION KAYAK AND PADDLEBOARD WATERCRAFT APPARATUS AND RELATED METHODS

FIELD OF THE DISCLOSURE

The present disclosure is generally related to self-propelled watercraft and more particularly is related to a combination kayak and paddleboard watercraft apparatus and related methods.

BACKGROUND OF THE DISCLOSURE

User-propelled watercraft, such as kayaks and paddleboards, have long been used for water transportation and recreation. With kayaks, one or two users sit within a cockpit formed within a hull. The hull may be constructed out of a variety of materials, such as plastic, wood, or fiberglass, generally has a hollow interior with a upper deck formed by the top surface of the hull. The user of the kayak faces forward with their legs in front, such that the waist and legs of the user are positioned within the hollow interior of the hull. Most kayaks have hollow interiors with closed decks, although other designs, such as inflatable kayaks are available. In use, the user in the seated position propels the kayak forward using a paddle with a blade at each end. Paddleboards are commonly formed from a foam material and generally have a unitary structure with a planar upper surface. In use, the user is positioned lying, kneeling, or standing on the upper surface of the paddleboard, propelling the paddleboard forward with their arms or with a paddle.

Both kayaking and paddleboarding are becoming increasingly popular as recreational activities. While a variety of kayak and paddleboard designs exist in the art today, most of these watercraft are geared towards a particular use and cannot be used flexibly or interchangeably. For example, most kayaks having hollow interiors and could not support the weight of a user standing on the top decking, whereas most paddleboards cannot accommodate a user comfortably sitting on the top surface and paddling with a conventional kayak technique with a two-bladed paddle. Accordingly, a user who wishes to kayak and paddleboard is forced to purchase both a kayak and a paddleboard depending on what activity they wish to engage in. Retrofit kits and conversion kits offer some abilities to use watercraft devices interchangeably. However, these kits are an added expense and commonly require lengthy setup time.

Thus, a heretofore unaddressed need exists in the industry to address the aforementioned deficiencies and inadequacies.

SUMMARY OF THE DISCLOSURE

Embodiments of the present disclosure provide a combination kayak and paddleboard watercraft. Briefly described, in architecture, one embodiment of the watercraft, among others, can be implemented as follows. A hull is formed from a substantially solid foam core. A rigid exterior coating is positioned on an exterior surface of the hull. A seating area is formed on the rigid exterior coating proximate to a top surface of the hull, the seating area having a seating cavity extending into the substantially solid foam core. A foot hold area is formed on the rigid exterior coating proximate to the top surface of the hull, the foot hold area having at least two foot cavities extending into the substantially foam core, wherein the at least two foot cavities are positioned remote from the seating cavity. A standing area is formed on the rigid exterior coating proximate to the top surface of the hull and is positioned substantially between the seating area and the foot hold area, wherein the standing area further comprises a standing pad affixed to at least one of the hull and the rigid exterior coating.

The present disclosure can also be viewed as providing a combination watercraft apparatus having a plurality of user-operating positions. Briefly described, in architecture, one embodiment of the apparatus, among others, can be implemented as follows. A hull is formed from a substantially solid foam core. A rigid exterior coating is positioned on an exterior surface of the hull. A seating area is formed on the rigid exterior coating proximate to a top surface of the hull, the seating area having a seating cavity extending into the substantially solid foam core. A foot hold area is formed on the rigid exterior coating proximate to the top surface of the hull, the foot hold area having at least two foot cavities extending into the substantially foam core, wherein the at least two foot cavities are positioned remote from the seating cavity. A standing area is formed on the rigid exterior coating proximate to the top surface of the hull and is positioned substantially between the seating area and the foot hold area, wherein the standing area further comprises a standing pad affixed to at least one of the hull and the rigid exterior coating. In a kayak user-operating position, a user's buttocks are positioned at least partially within the seating cavity and the user's feet are positioned within the at least two foot cavities, and in a paddleboard user-operating position, the user is standing on the standing pad.

The present disclosure can also be viewed as providing methods of manufacturing a combination kayak and paddleboard watercraft. In this regard, one embodiment of such a method, among others, can be broadly summarized by the following steps: shaping a substantially solid foam core into a hull; forming a seating cavity within the substantially solid foam core; forming at least two foot cavities within the substantially solid foam core; applying an exterior coating to an exterior surface of the hull, wherein at least a portion of the exterior coating is fluid; curing the exterior coating to a substantially rigid state; and affixing a standing pad to at least one of the substantially solid foam core and the rigid exterior coating, wherein the standing pad is located substantially between the seating cavity and the at least two foot cavities.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
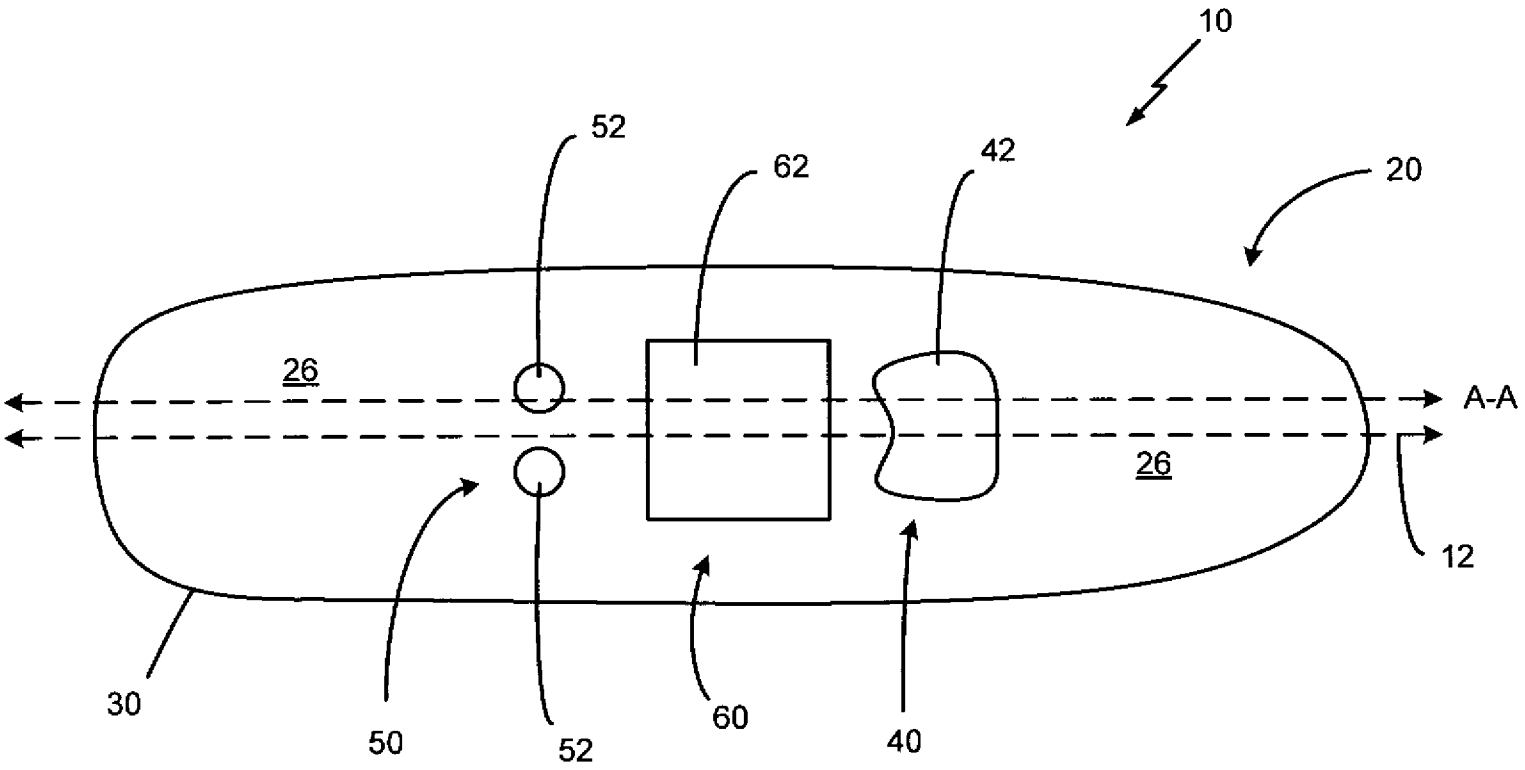
FIG. 1 is a top view illustration of a combination kayak and paddleboard watercraft, in accordance with a first exemplary embodiment of the present disclosure.
Figure 2:
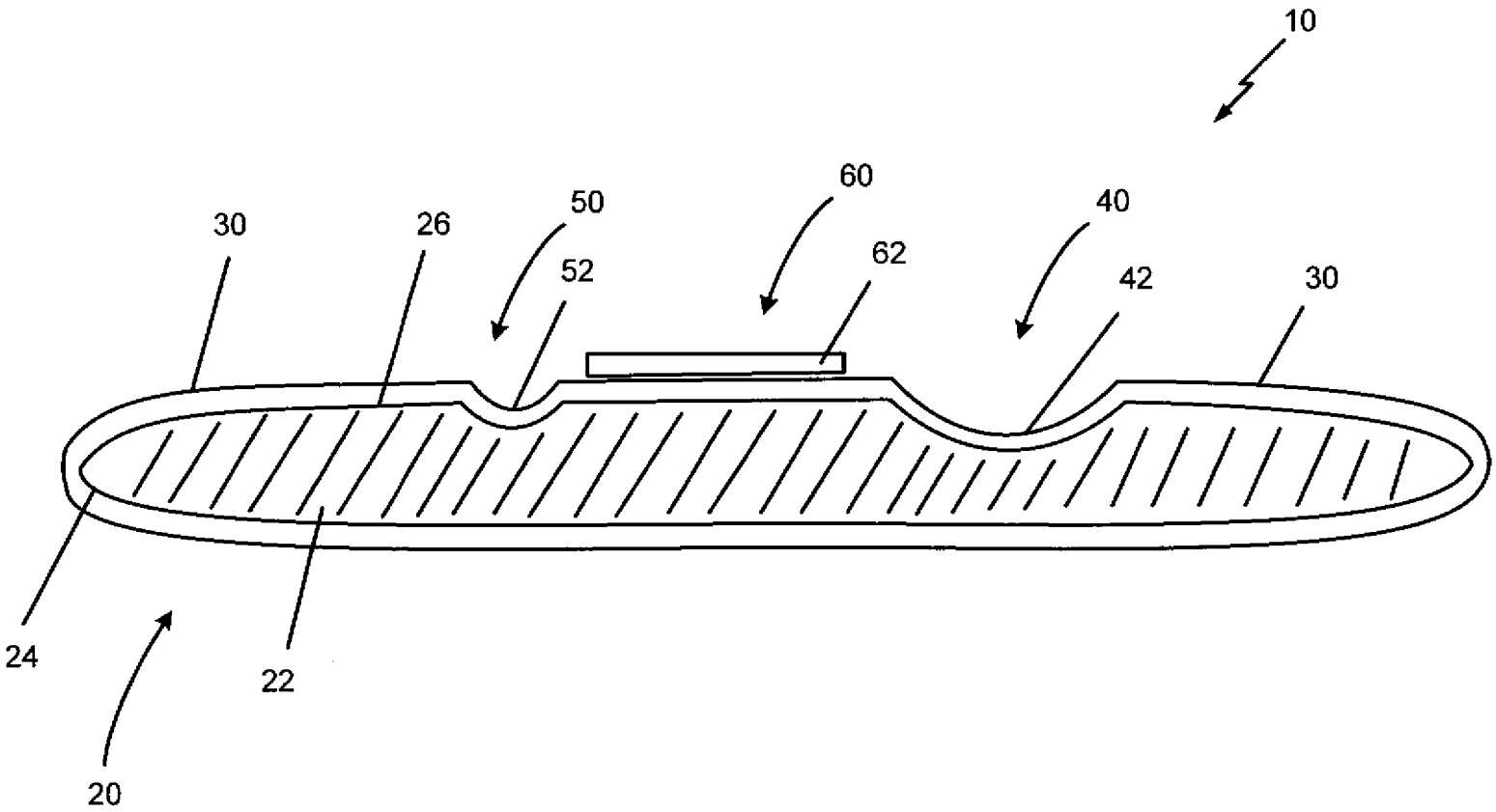
FIG. 2 is a cross-sectional illustration of the combination kayak and paddleboard watercraft of FIG. 1 along the line A-A, in accordance with the first exemplary embodiment of the present disclosure.

FIG. 1 is a top view illustration of a combination kayak and paddleboard watercraft 10, in accordance with a first exemplary embodiment of the present disclosure. FIG. 2 is a cross-sectional illustration of the combination kayak and paddleboard watercraft 10 of FIG. 1 along the line A-A, in accordance with a first exemplary embodiment of the present disclosure. With reference to FIGS. 1-2, the combination kayak and paddleboard watercraft 10, which may be referred to herein simply as 'watercraft 10,' has a hull 20 formed from a substantially solid foam core 22. A rigid exterior coating 30 is positioned on an exterior surface 24 of the hull 20. A seating area 40 is formed on the rigid exterior coating 30 proximate to a top surface 26 of the hull 20. The seating area 40 has a seating cavity 42 extending into the substantially solid foam core 22. A foot hold area 50 is formed on the rigid exterior coating 30 proximate to the top surface 26 of the hull 20. The foot hold area 50 has at least two foot cavities 52 extending into the substantially foam core 22, wherein the at least two foot cavities 52 are positioned remote from the seating cavity 42. A standing area 60 is formed on the rigid exterior coating 30 proximate to the top surface 26 of the hull 20 and is positioned substantially between the seating area 40 and the foot hold area 50. The standing area 60 has a standing pad 62 affixed to at least one of the hull 20 and the rigid exterior coating 30.

The watercraft 10 may be characterized as a watercraft device or apparatus that allows users the ability to operate the watercraft 10 as a kayak or as a paddleboard, or as another type of similar watercraft. The watercraft 10 is a substantially unitary structure that may be universally used by persons of varying sizes and abilities. Capable of being used in many water settings, such as on the ocean, a lake, a pond, a stream, a river, or a man-made body of water, the watercraft 10 is durable and provides flexible functionality.

The hull 20 of the watercraft 10 is formed from a substantially solid foam core 22. The substantially solid foam core 22 may be an expanded polystyrene (EPS) material, or a similar material, such as other synthetic polymers constructed from styrene. It may be preferable for the hull 20 to be formed only from the solid foam core 22 with the rigid exterior coating 30 affixed directly to the solid foam core 22. The hull 20 may have any size or dimensions as may be appropriate for use of the watercraft 10. It is preferably for the hull 20 to be sized to accommodate an adult user and a child user, and any size user therebetween. For example, the hull 20 may have a length, from a bow to a stem, of between 3-7 feet, a width of 1-3 feet, and a thickness from the top surface 26 to a bottom surface of a few to many inches. The hull 20 may further have any outline shape and any cross sectional shape, including a hard or a soft chine hull, depending on the intended use of the watercraft 10. As is shown in FIGS. 1-2, the hull 20 may be substantially planar, in that the top surface 26 may be substantially flat with the portions of the top surface 26 proximate to the bow and stern being slightly raised.

The solid foam core 22 of the hull 20 is covered, at least partially, in a rigid exterior coating 30. The rigid exterior coating 30 is generally positioned on all exterior surfaces 24 of the hull 20, however the rigid exterior coating 30 may be absent on portions of the solid foam core 22. The rigid exterior coating 30 may include a fiberglass material and an epoxy resin which is applied to the solid foam core 22 and then cured to a hardened or rigid state. A number of layers of the rigid exterior coating 30 may be used, such that the fiberglass and epoxy is laminated around the solid foam core 22. Any type of fiberglass and resin combination, or other similar materials, may be utilized and are considered within the scope of the present disclosure. The rigid exterior coating 30 may also include other materials, such as waxes, friction-enhancing or friction-reducing materials, decals, graphics, clear coatings and/or protectants.

The seating area 40 is formed on the exterior of the rigid exterior coating 30 proximate to the top surface 26 of the hull 20, i.e., the outermost upper surface of the hull 20 with rigid exterior coating 30. The seating area 40 may be characterized as the portion of the watercraft 10 where a user places his or her buttocks when using the watercraft as a kayak. Generally, the seating area 40 will be positioned between a middle location of the hull 20 and the stern of the watercraft 10, and substantially aligned with a center axis 12 of the watercraft 10. The seating cavity 42 of the seating area 40 extends into the substantially solid foam core 22, such that the depth of the seating cavity 42 extends interior of the top surface 26 of the hull 20. The seating cavity 42 may have a variety of sizes and dimensions, including a variety of depths, sloped edges, and footprint shapes. For example, as is shown in FIG. 1, the seating cavity 42 may have a shape with a rounded outline that is selected to comfortably fit a user's buttocks.

Similar to the seating area 40, the foot hold area 50 is formed on the rigid exterior coating 30 proximate to the top surface 26 of the hull 20. The foot hold area 50 is, however, positioned remote from the seating area 40, such that a user's buttocks can be positioned in the seating area 40 with their feet positioned in the foot hold area 50. The foot hold area 50 has at least two foot cavities 52 extending into the substantially foam core 22. Each of the two foot cavities 52 may receive the heels of a user's foot when the user is seated in the seating area 40. Accordingly, the foot cavities 52 may have a variety of sizes and dimensions, including a variety of depths, sloped edges, and footprint shapes, such as with a rounded outline that is selected to comfortably fit the user's heels. The foot cavities 52 may be spaced equidistantly about the center axis 12 of the hull 20.

In contrast to conventional kayaks which utilize a hollow interior with a seat, where the user sits within the hollow interior with their legs positioned under the deck, the seating cavity 42 and the foot cavities 52 are directly accessible from the top surface 26 of the watercraft 10 and are not positioned directly underneath a deck of the watercraft 10. Rather, the seating cavity 42 and the foot cavities 52 are indentations that are not positioned within any interior hollow space. Furthermore, the seating cavity 42 and the foot cavities 52 each have a cavity bottom that is positioned below the top surface 26 of the hull.

The standing area 60 is formed on the rigid exterior coating 30 proximate to the top surface 26 of the hull 20. As is shown best in FIG. 2, the standing area 60 is wholly formed above the top surface 26 of the hull 20, such that when a user stands or kneels on the standing area 60, their knees or feet are not positioned below the top surface 26. The top surface of the standing area 50, without the standing pad 62, may be substantially coplanar with the rigid exterior coating 30 on the top surface 26 of the hull 20 at a stem and a bow of the hull 10. To provide the best balancing of the user on the watercraft 10, the standing area 60 may be positioned at a center balance of the hull 20, substantially between the seating area 40 and the foot hold area 50. The standing area 60 has a standing pad 62 affixed to at least one of the hull 20 and the rigid exterior coating 30. The standing pad 62 may be affixed to the hull 20 and/or the rigid exterior coating 30 with a variety of devices, including adhesives, mechanical fasteners, and integral connectors. The standing pad 62 (which could be characterized as a kneeling pad when a user is kneeling on it) may include any type of material for providing comfort and functionality to the user. For example, the standing pad 62 may have high friction properties in wet conditions and may offer comfort to the user's feet or knees, yet still allow the user to exert control of the watercraft 10.

Figure 3:
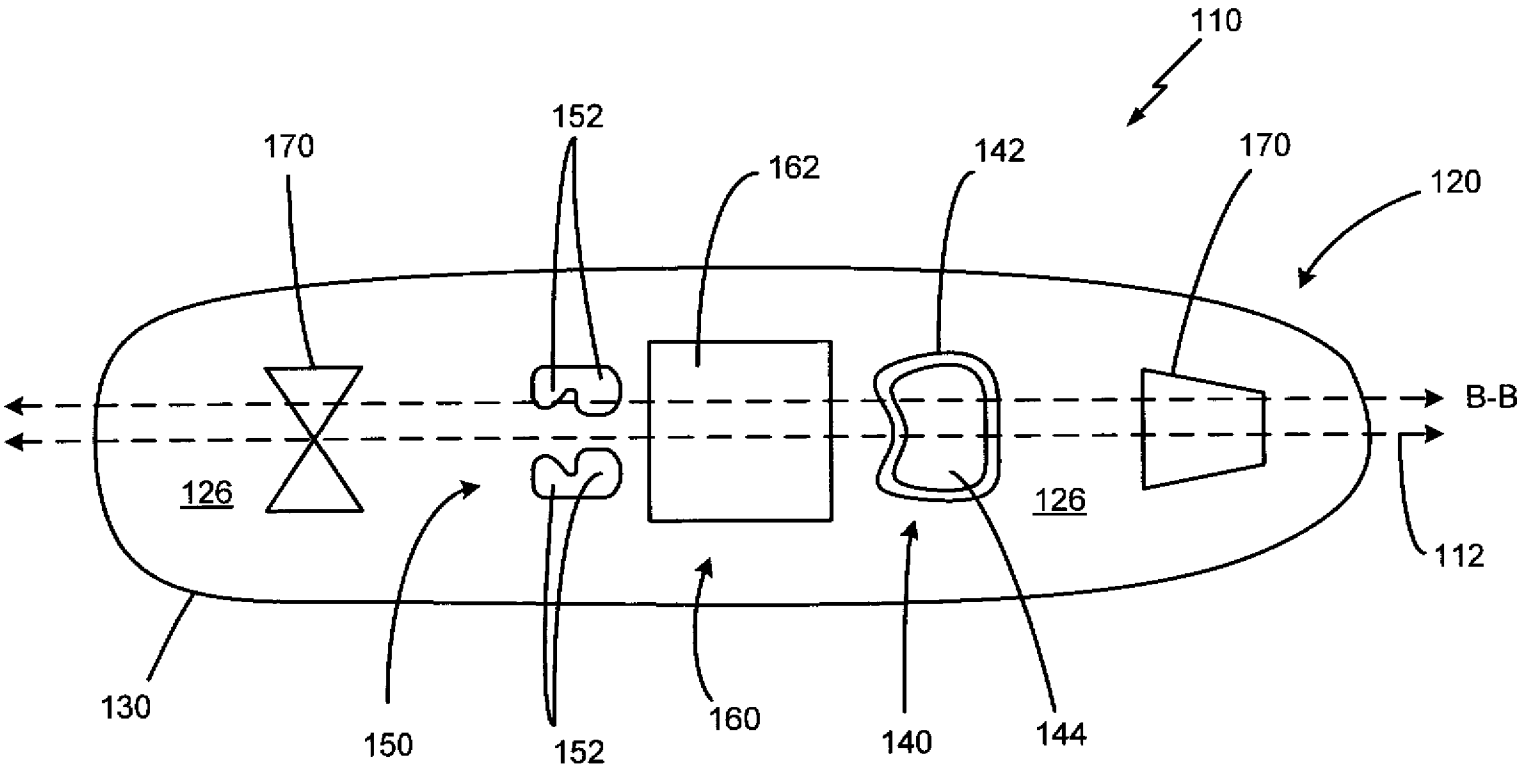
FIG. 3 is a top view illustration of a combination kayak and paddleboard watercraft, in accordance with a second exemplary embodiment of the present disclosure.
Figure 4:
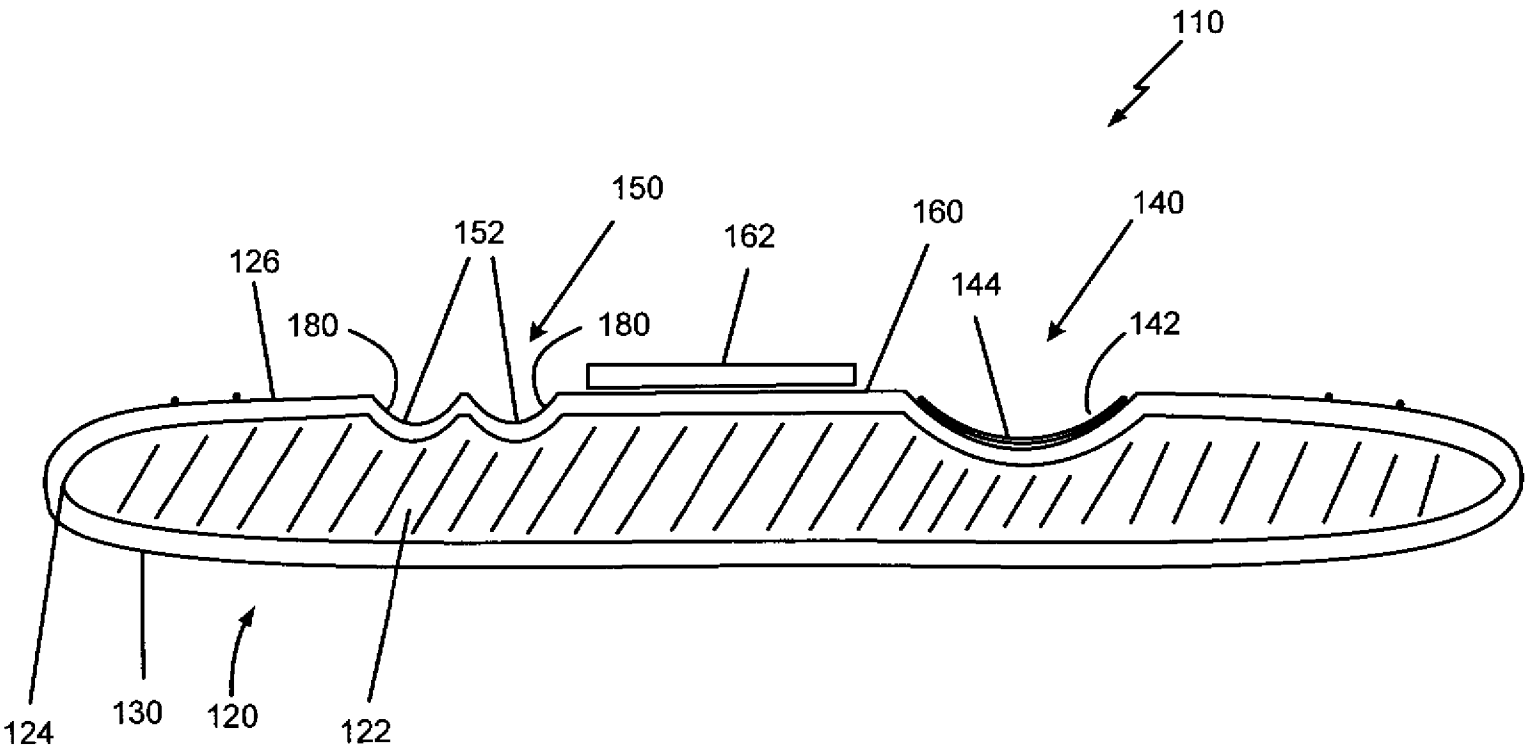
FIG. 4 is a cross-sectional illustration of the combination kayak and paddleboard watercraft of FIG. 3 along the line B-B, in accordance with the second exemplary embodiment of the present disclosure.

FIG. 3 is a top view illustration of a combination kayak and paddleboard watercraft 110, in accordance with a second exemplary embodiment of the present disclosure. FIG. 4 is a cross-sectional illustration of the combination kayak and paddleboard watercraft 110 of FIG. 3 along the line B-B, in accordance with the second exemplary embodiment of the present disclosure. The combination kayak and paddleboard watercraft 110, which may be referred to herein simply as 'watercraft 110,' may include any of the features, component, structures, or functions of any embodiment of this disclosure.

Similar to the first exemplary embodiment and with reference to FIGS. 3-4, the watercraft 110 has a hull 120 formed from a substantially solid foam core 122. A rigid exterior coating 130 is positioned on an exterior surface 124 of the hull 120. A seating area 140 is formed on the rigid exterior coating 130 proximate to a top surface 126 of the hull 120. The seating area 140 has a seating cavity 142 extending into the substantially solid foam core 122. A foot hold area 150 is formed on the rigid exterior coating 130 proximate to the top surface 126 of the hull 120. The foot hold area 150 has at least two foot cavities 152 extending into the substantially foam core 122, wherein the at least two foot cavities 152 are positioned remote from the seating cavity 142. A standing area 160 is formed on the rigid exterior coating 130 proximate to the top surface 126 of the hull 120 and is positioned substantially between the seating area 140 and the foot hold area 150. The standing area 160 has a standing pad 162 affixed to at least one of the hull 120 and the rigid exterior coating 130.

The foot hold area 150 includes four foot cavities 152, with two on either side of the center axis 112, however, more than four cavities 152 may also be include. Two of the foot cavities 152 may be spaced a first linear distance from the seating cavity 142 while a second two of the foot 152 cavities may be spaced a second linear distance from the seating cavity 142, the first linear distance being different from the second linear distance. As can be understood, the watercraft 110 with four foot cavities 152 may accommodate users of different heights or give users flexibility is seating positions. For example, a shorter user may utilize the foot cavities 152 positioned closest to the seating cavity 142, while a taller user may utilize the foot cavities 152 positioned furthest from the seating cavity 142. A user may also choose between each of the foot cavities 152 depending on which seating position is desired, i.e., utilizing the foot cavities 152 positioned closest to the seating cavity 142 may raise the user's knees while utilizing the foot cavities 152 positioned furthest from the seating cavity 142 may lower the user's knees. Additionally, the positions of the foot cavities 152 relative to the center axis 112 may also vary. The foot cavities 152 may all be spaced equidistantly about a center axis 112 of the hull 120, with some foot cavities 152 positioned nearer the center axis 112 and some positioned further away.

The foot cavities 152 may all include one or a plurality of sloped edges 180. The sloped edges 180 may provide comfort to the user and enhance control of the watercraft 110. The sloped edges 180 may be connected between the rigid exterior coating 130 proximate to the top surface 126 of the hull 120 and a floor of each of the at least two cavities 152, respectively.

Also shown in FIG. 3, the seating cavity 142 may include a seating pad 144 to enhance a user's comfort and control of the watercraft 110. The seating pad 144 may be affixed to the hull 120 and/or the rigid exterior coating 130 with a variety of devices, including adhesives, fasteners, and/or connectors. The seating pad 144 may be constructed from a variety of material, including materials similar to the standing pad 162. The seating pad 144 may be sized to fit wholly or partially within the seating cavity 142 and may include any shapes or dimensions.

Other devices and features may be used with the watercraft 110. For example, the watercraft 110 may include elastic retainers 170 affixed to the top surface 126 of the hull 120. The elastic retainers 170 may allow a user to secure their belongings to the top surface 126 while they're using the watercraft 110. Another feature that may be included is one or more fins that is removably affixed to a bottom of the watercraft 110. While the overall size of the watercraft 110 may vary, some length/width/height sizes may include: 84"×25"×5"; 96"×29"×5"; 108"×31"×5"; 120"×32"×5"; 132"×34"×6"; and any others. The weight of an average size watercraft 110 overall may be between 12-20 pounds.

Figure 5:
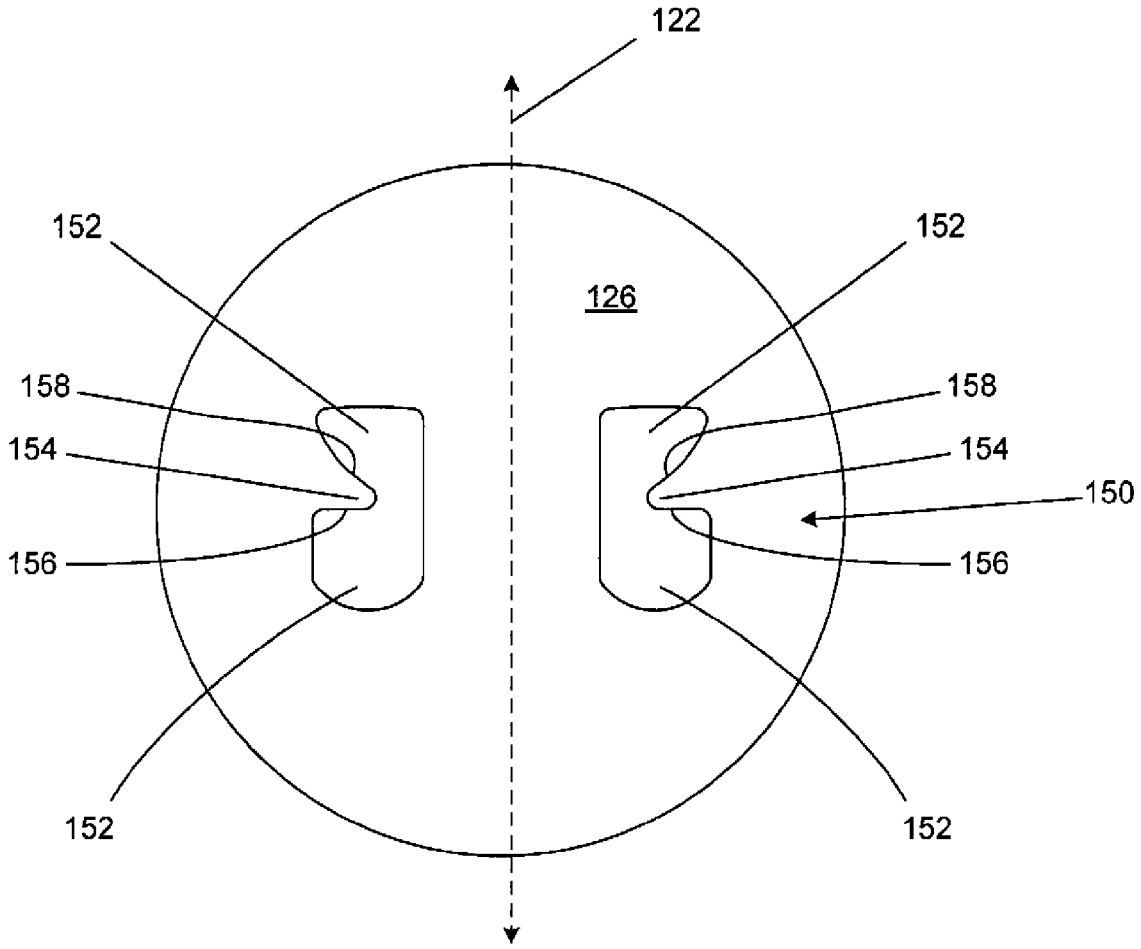
FIG. 5 is a top view illustration of the foot hold area of the combination kayak and paddleboard watercraft of FIG. 3, in accordance with the second exemplary embodiment of the present disclosure.

FIG. 5 is a top view illustration of the foot hold area 150 of the combination kayak and paddleboard watercraft 110 of FIG. 3, in accordance with the second exemplary embodiment of the present disclosure. The foot hold area 150 may include foot cavities 152 that are fully or partially interconnected. For example, two or more of the foot cavities 152 may be adjoining, where the bottom surfaces of the adjoining foot cavities 152 are connected at a height below the top surface 126 of the hull 120 (FIGS. 3-4). Interconnected foot cavities 152 may allow a user to conveniently move their heels between the foot cavities 152 without having to lift their leg or otherwise move their heel out of a foot cavity 152. This ability may be particularly beneficial in allowing a user to keep control over the watercraft 110, since control over the watercraft 110 with the user's feet may momentarily lessen when a user removes their heel from the foot cavity 152.

A partial separation ridge 154 may be positioned between the interconnected foot cavities 152. The partial separation ridge 154 may act as a barrier between the interconnected foot cavities 152. For example, a front face 156 of the partial separation ridge 154 may act as a stop for the bottom of the user's foot when the foot is positioned in the foot cavity 152 located nearest the seating cavity 142 (see FIG. 3). A rear face 158 of the partial separation ridge 154 may act as an upper heel rest for the user's foot when the user's foot is positioned in the foot cavity 152 located furthers from the seating cavity 142 (see FIG. 3). The partial separation ridge 154 may extend partially across a width of the foot cavities 152 such that the user can select which foot cavity 152 to use by sliding their heel to a position along the width of the foot cavity 152.

Figure 6:
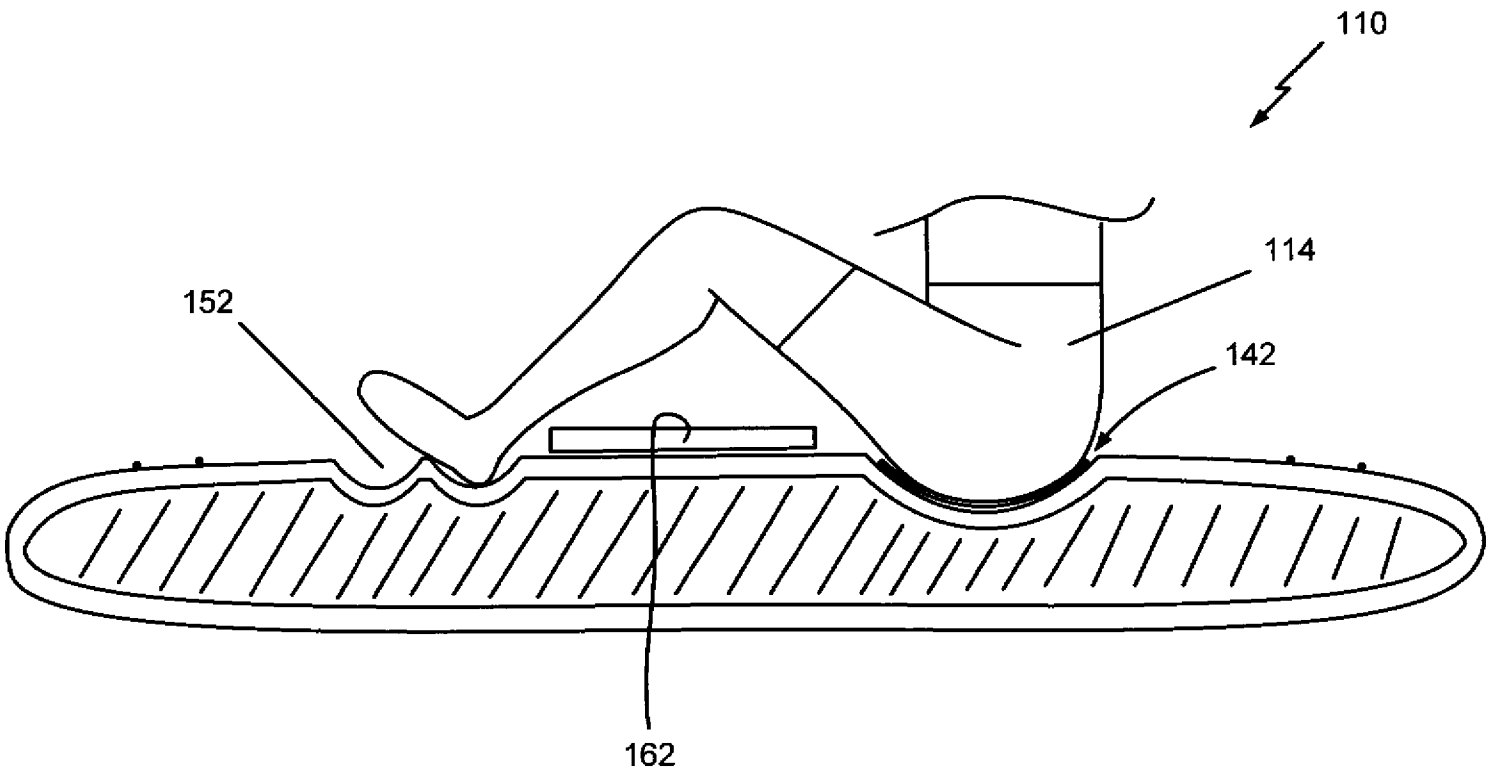
FIG. 6 is a cross-sectional illustration of the combination kayak and paddleboard watercraft of FIG. 3 along the line B-B, in accordance with the second exemplary embodiment of the present disclosure.

FIG. 6 is a cross-sectional illustration of the combination kayak and paddleboard watercraft 110 of FIG. 3 along the line B-B, in accordance with the second exemplary embodiment of the present disclosure. In FIG. 6, the user 114 is depicted in the kayak user-operating position, such that the user 114 can operate the watercraft 110 as a kayak. Accordingly, the buttocks of the user 114 is positioned within the seating cavity 142 and the heels of the user's feet are positioned within the foot cavity 152. In this position, the user 114 can paddle the watercraft with a single or double-bladed paddle (not shown) while retaining control over the watercraft 110 through their contact with the seating cavity 142 and the foot cavities 152.

Figure 7:
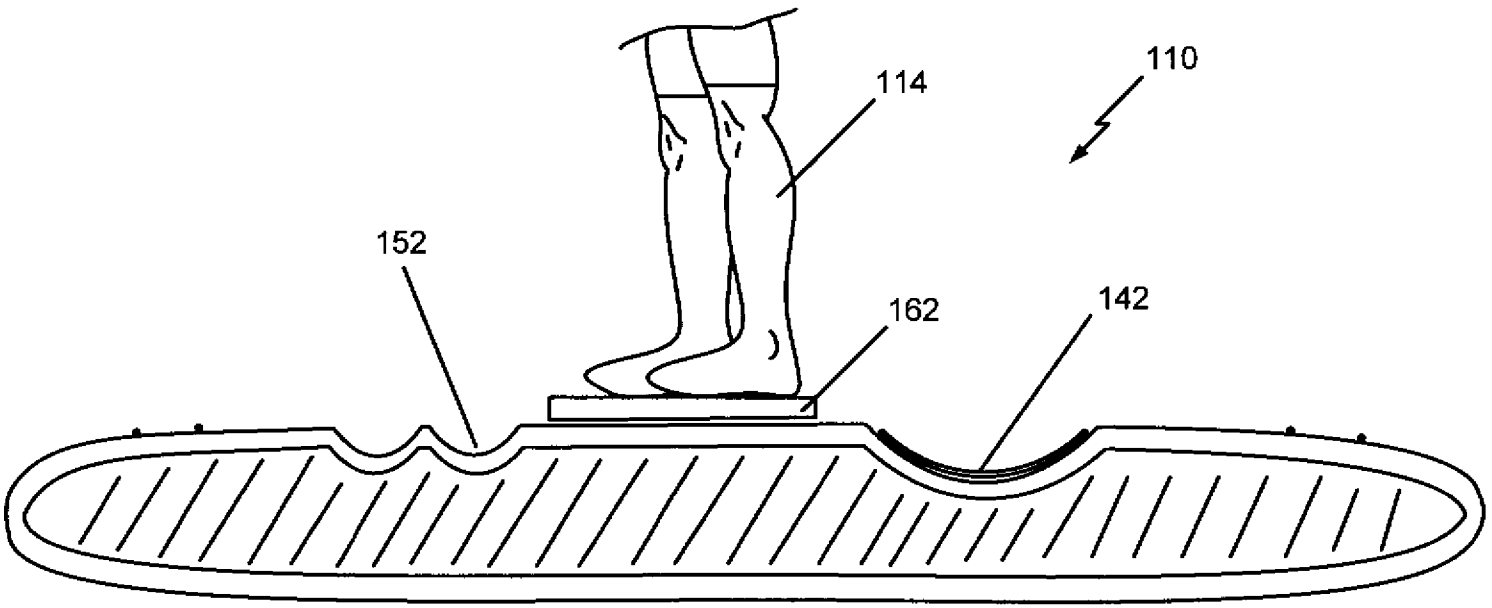
FIG. 7 is a cross-sectional illustration of the combination kayak and paddleboard watercraft of FIG. 3 along the line B-B, in accordance with the second exemplary embodiment of the present disclosure.

FIG. 7 is a cross-sectional illustration of the combination kayak and paddleboard watercraft 110 of FIG. 3 along the line B-B, in accordance with the second exemplary embodiment of the present disclosure. In FIG. 7, the user 114 is depicted in the standing paddleboard user-operating position, such that the user 114 can operate the watercraft 110 as a paddleboard from the standing position. Accordingly, the feet of the user 114 are positioned on the standing pad 162, while the seating cavity 142 and foot cavities 152 remain unused. In this position, the user 114 can paddle the watercraft with a paddle, such as a single-bladed paddle (not shown), while retaining control over the watercraft 110 through their contact with the standing pad 162.

Figure 8:
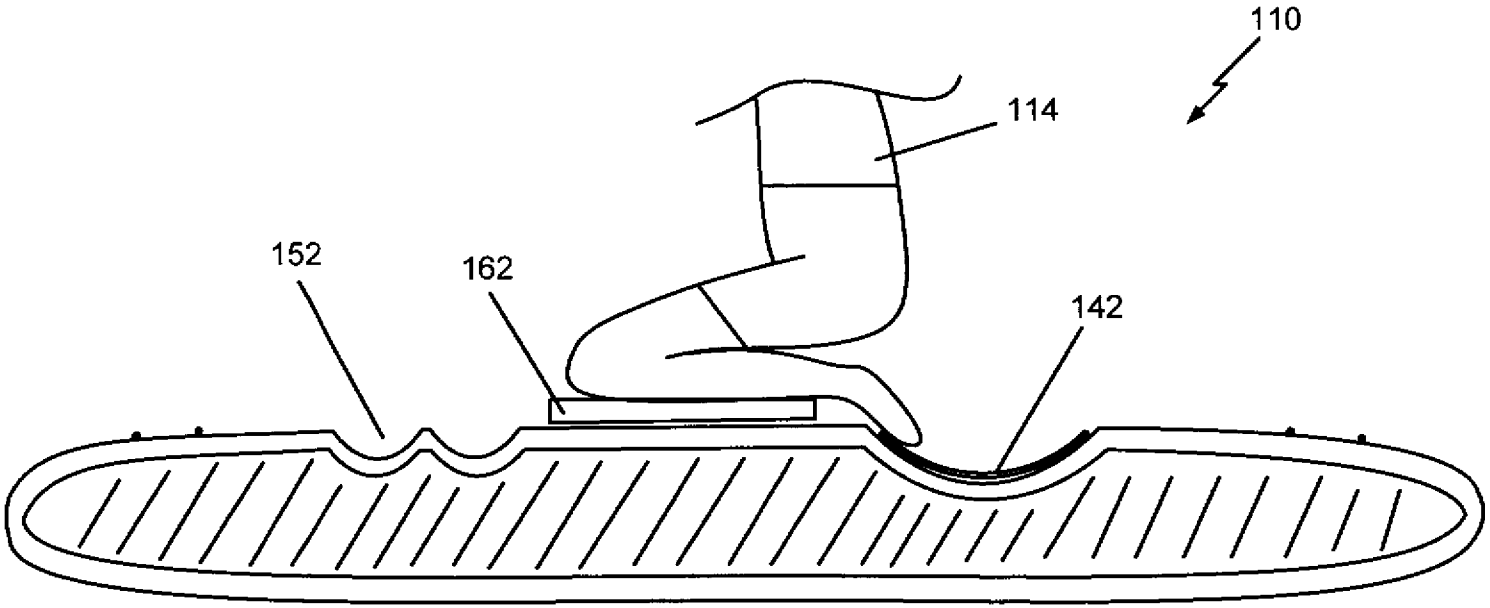
FIG. 8 is a cross-sectional illustration of the combination kayak and paddleboard watercraft of FIG. 3 along the line B-B, in accordance with the second exemplary embodiment of the present disclosure.

FIG. 8 is a cross-sectional illustration of the combination kayak and paddleboard watercraft 110 of FIG. 3 along the line B-B, in accordance with the second exemplary embodiment of the present disclosure. In FIG. 8, the user 114 is depicted in the kneeling paddleboard user-operating position, such that the user 114 can operate the watercraft 110 as a paddleboard from the kneeling position. Accordingly, the knees and lower legs of the user 114 are positioned on the standing pad 162, while the seating cavity 142 and foot cavities 152 remain largely unused (the user's feet may extend into the seating cavity 142). In this position, the user 114 can paddle the watercraft with a paddle, such as a single or double-bladed paddle (not shown), while retaining control over the watercraft 110 through their contact with the standing pad 162.

Figure 9:
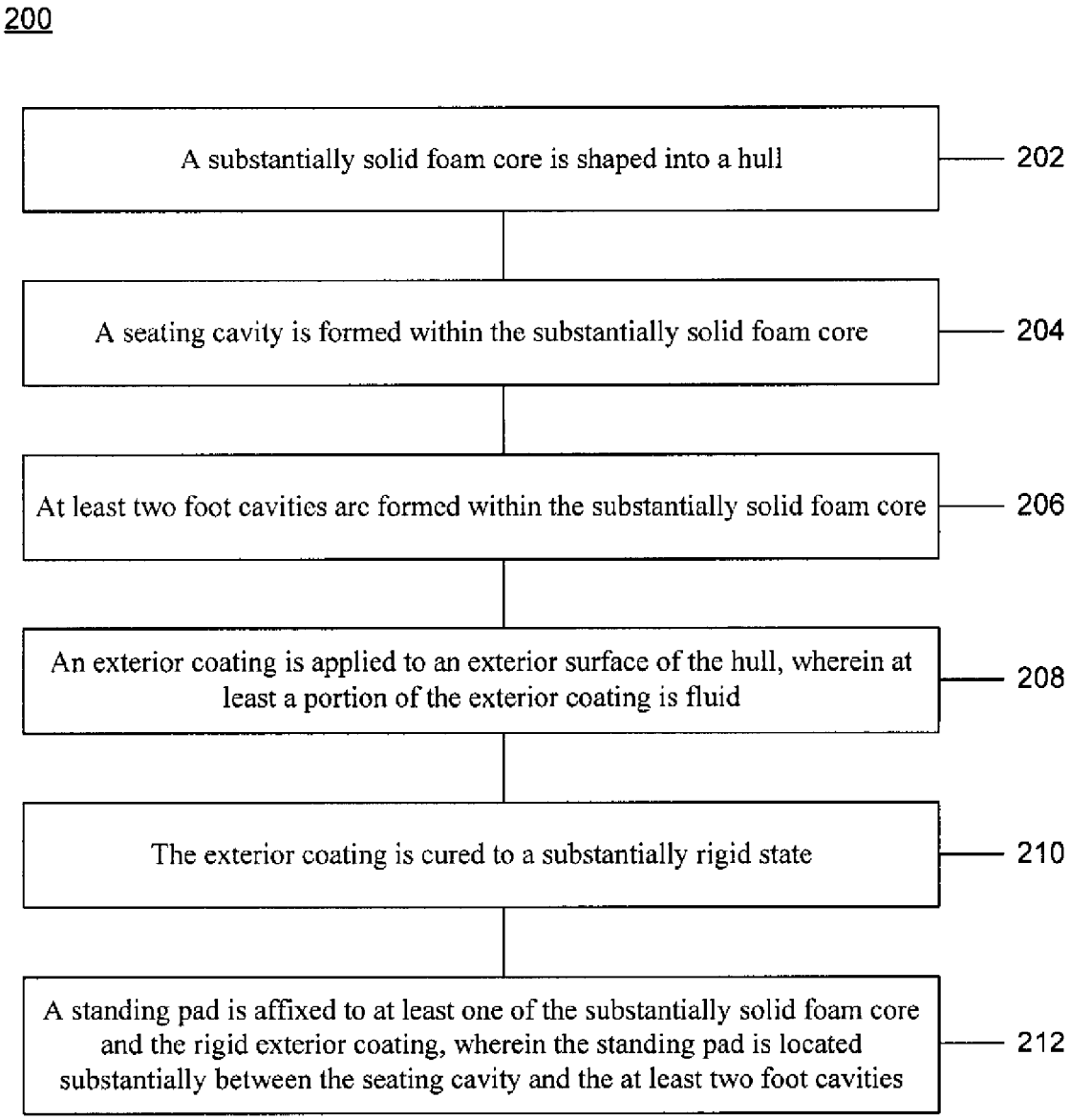
FIG. 9 is a flowchart illustrating a method of manufacturing a combination kayak and paddleboard watercraft, in accordance with a third exemplary embodiment of the present disclosure.

FIG. 9 is a flowchart 200 illustrating a method of manufacturing a combination kayak and paddleboard watercraft, in accordance with a third exemplary embodiment of the present disclosure. It should be noted that any process descriptions or blocks in flow charts should be understood as representing modules, segments, or steps that include one or more instructions for implementing specific logical functions in the process, and alternate implementations are included within the scope of the present disclosure in which functions may be executed out of order from that shown or discussed, including substantially concurrently or in reverse order, depending on the functionality involved, as would be understood by those reasonably skilled in the art of the present disclosure.

As is shown by block 202, a substantially solid foam core is shaped into a hull. A seating cavity is formed within the substantially solid foam core (block 204). At least two foot cavities are formed within the substantially solid foam core (block 206). An exterior coating is applied to an exterior surface of the hull, wherein at least a portion of the exterior coating is fluid (block 208). The exterior coating is cured to a substantially rigid state (block 210). A standing pad is affixed to at least one of the substantially solid foam core and the rigid exterior coating, wherein the standing pad is located substantially between the seating cavity and the at least two foot cavities (block 212).

The method may include any additional number of steps, processes, or variations thereof, including any of the steps, processes, or functions disclosed relative to FIGS. 1-8. For example, the seating cavity and at least two foot cavities may be formed within the substantially solid foam core by molding the substantially solid foam core. Molding the solid foam core may include using an expanded polystyrene molding process whereby polystyrene is shaped using a mold. The seating cavity and at least two foot cavities may also be formed within the substantially solid foam core by carving the substantially solid foam core. For example, the seating cavity and at least two foot cavities may be carved or machined from the solid foam core using manual or automatic devices, including computed numerical control (CNC) machines.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. A combination kayak and paddleboard watercraft comprising:

a hull formed from a unitary solid foam core;

a rigid exterior coating positioned on an exterior surface of the hull;

a seating area formed on the rigid exterior coating proximate to a top surface of the hull, the seating area having a seating cavity extending into the unitary solid foam core;

a foot hold area formed on the rigid exterior coating proximate to the top surface of the hull, the foot hold area having at least two foot cavities extending into the foam core, wherein the at least two foot cavities are positioned remote from the seating cavity; and a non-cockpit standing area having a standing pad affixed to the rigid exterior coating on the top surface of the unitary solid foam core hull, wherein the standing area is positioned substantially between the seating area and the foot hold area.

2. The combination kayak and paddleboard watercraft of claim 1, wherein the unitary solid foam core further comprises an expanded polystyrene (EPS) form core.

3. The combination kayak and paddleboard watercraft of claim 1, wherein the rigid exterior coating further comprises at least one of fiberglass and epoxy resin.

4. The combination kayak and paddleboard watercraft of claim 3, wherein the rigid exterior coating further comprises a laminated fiberglass and epoxy resin in a cured state.

5. The combination kayak and paddleboard watercraft of claim 1, wherein the rigid exterior coating is positioned on all exterior surfaces of the hull.

6. The combination kayak and paddleboard watercraft of claim 1, further comprising a seating pad positioned at least partially within the seat cavity, wherein the seating pad is affixed to at least one of the hull and the rigid exterior coating.

7. The combination kayak and paddleboard watercraft of claim 1, wherein the at least two foot cavities of the foot hold area are spaced equidistantly about a center axis of the hull.

8. The combination kayak and paddleboard watercraft of claim 1, wherein the at least two foot cavities of the foot hold area further comprises at least four cavities.

9. The combination kayak and paddleboard watercraft of claim 8, wherein a first two of the at least four foot cavities of the foot hold area are spaced equidistantly about a center axis of the hull and a second two of the at least four foot cavities are spaced equidistantly about the center axis of the hull.

10. The combination kayak and paddleboard watercraft of claim 8, wherein a first two of the at least four foot cavities of the foot hold area are spaced a first linear distance from the seating cavity of the seating area and a second two of the at least four foot cavities of the food hold area are spaced a second linear distance from the seating cavity of the seating area, wherein the first linear distance is different from the second linear distance.

11. The combination kayak and paddleboard watercraft of claim 1, wherein the standing area is at least partially located at a center of balance of the hull.

12. The combination kayak and paddleboard watercraft of claim 1, wherein each of the at least two foot cavities of the foot hold area further comprise at least one sloped edge, wherein the at least one sloped edge is connected between the rigid exterior coating proximate to the top surface of the hull and a floor of each of the at least two foot cavities, respectively.

13. The combination kayak and paddleboard watercraft of claim 1, wherein a top surface of the standing area is substantially coplanar with the rigid exterior coating on the top surface of the hull at a stem and a bow of the hull.

14. The combination kayak and paddleboard watercraft of claim wherein the hull is formed only from the unitary solid foam core.

15. A method of manufacturing a unitary solid foam core kayak watercraft, the method comprising the steps of:

shaping a unitary solid foam core into a hull;

forming a seating cavity within the unitary solid foam core;

forming at least two foot cavities within the unitary solid foam core;

applying an exterior coating to an exterior surface of the hull, wherein at least a portion of the exterior coating is fluid;

curing the exterior coating to a substantially rigid state; and affixing a standing pad to an exterior surface of the rigid exterior coating positioned above the unitary solid foam core, wherein the standing pad is located substantially between the seating cavity and the at least two foot cavities.

16. The method of claim 15, wherein the steps of forming the seating cavity within the unitary solid foam core and forming the at least two foot cavities within the unitary solid foam core further comprises molding the unitary solid foam core.

17. The method of claim 15, wherein the steps of forming the seating cavity within the unitary solid foam core and forming the at least two foot cavities within the unitary solid foam core further comprises carving the unitary solid foam core.

18. The combination kayak and paddleboard watercraft of claim 13, wherein a top surface of the standing pad is positioned above a top surface of the rigid exterior coating of the hull at the stern and the bow of the hull.

19. A unitary solid foam core kayak watercraft comprising:

a hull formed from a unitary solid foam core;

a rigid exterior coating positioned on an exterior surface of the hull;

a seating area formed on the rigid exterior coating proximate to a top surface of the hull, the seating area having a seating cavity extending into the unitary solid foam core;

a foot hold area formed on the rigid exterior coating proximate to the top surface of the hull, the foot hold area having at least two foot cavities extending into the substantially foam core, wherein the at least two foot cavities are positioned remote from the seating cavity; and a non-cockpit standing area formed at least partially between the seating area and the foot hold area, the non-cockpit standing area having a standing pad affixed to the top surface of the hull.

20. The unitary solid foam core kayak watercraft of claim 19, wherein a top surface of the non-cockpit standing area is substantially coplanar with the rigid exterior coating on the top surface of the hull at a stern and a bow of the hull.

* * * * *

UNITED STATES PATENT AND TRADEMARK OFFICE

CERTIFICATE OF CORRECTION

PATENT NO. : 9,199,702 B2
APPLICATION NO. : 14/108836
DATED : December 1, 2015
INVENTOR(S) : Cregier et al.

It is certified that error appears in the above-identified patent and that said Letters Patent is hereby corrected as shown below:

On the title page

Item 71, "Kypad Inc., Salem, NH" should read --Applicant: Kypad Inc., Salem, MA--.

Item 72, "Patricia Cregier, Salem, NH" should read --Inventors: Patricia Cregier, Salem, MA--.

In the claims

Col. 9, Claim 10, Line 18, "food" should read --foot--.

Col. 9, Claim 13, Line 35, "stem" should read --stern--.

Col. 9, Claim 14, Line 37, "of claim" should read --of claim 1--.

Signed and Sealed this
Tenth Day of May, 2016

Michelle K. Lee

Michelle K. Lee
*Director of the United States Patent and Trademark Office*